US011259619B2

(12) United States Patent
Han

(10) Patent No.: US 11,259,619 B2
(45) Date of Patent: Mar. 1, 2022

(54) POUCH-TYPE LIQUID COLOR MAKEUP CONTAINER

(71) Applicant: Chang Jin Yang, Pocheon (KR)

(72) Inventor: Young Min Han, Cheongju-si (KR)

(73) Assignee: Chang Jin Yang, Pocheon-si (KR)

( * ) Notice: Subject to any disclaimer, the term of this patent is extended or adjusted under 35 U.S.C. 154(b) by 0 days.

(21) Appl. No.: 17/059,430

(22) PCT Filed: Jun. 4, 2018

(86) PCT No.: PCT/KR2018/006363
§ 371 (c)(1),
(2) Date: Nov. 28, 2020

(87) PCT Pub. No.: WO2019/231030
PCT Pub. Date: Dec. 5, 2019

(65) Prior Publication Data

US 2021/0153626 A1 May 27, 2021

(30) Foreign Application Priority Data

May 29, 2018 (KR) ..... 10-2018-0061328

(51) Int. Cl.

| | |
|---|---|
| ***A45D 34/04*** | (2006.01) |
| ***A45D 34/00*** | (2006.01) |
| ***A45D 40/26*** | (2006.01) |
| ***B65D 51/32*** | (2006.01) |
| ***B65D 25/40*** | (2006.01) |

(52) U.S. Cl.
CPC ..... *A45D 34/045* (2013.01); *B65D 51/32* (2013.01); *A45D 34/042* (2013.01);
(Continued)

(58) Field of Classification Search
CPC .. A45D 34/034; A45D 34/042; A45D 34/046; A45D 40/265; A45D 40/262;
(Continued)

(56) References Cited

U.S. PATENT DOCUMENTS 6,523,548 B2 * 2/2003 Bouix ..... A45D 40/265 132/218
7,232,042 B2 * 6/2007 Last ..... B65D 75/5883 222/1

(Continued)

FOREIGN PATENT DOCUMENTS

KR 20-0248547 Y1 10/2001
KR 20-2010-0004811 U 5/2010

(Continued)

*Primary Examiner* — David J Walczak
(74) *Attorney, Agent, or Firm* — Maschoff Brennan

(57) ABSTRACT

A cosmetic container is manufactured as a pouch type to accommodate a small amount of liquid cosmetics. The pouch-type liquid color makeup container facilitates confirmation of whether the container is initially opened and exhibition and selling of the container in a vending machine and the like while enabling cosmetic materials to be conveniently carried and used indoors/outdoors through the attachment/detachment of a cap and the entrance/exit of cosmetic tools. A cap attachment/detachment and cosmetic tool entrance/exit and rail movement guide are provided in a discharge member of a pouch manufactured so as to receive and portably carry a small amount of liquid cosmetics, such as lip gloss, mascara, and eyeliner; enabling detailed application by being stably held, thereby enabling various demands of young people sensitive to color to be satisfied.

7 Claims, 2 Drawing Sheets

(52) U.S. Cl.
CPC ..... *A45D 40/262* (2013.01); *A45D 40/265* (2013.01); *A45D 2034/002* (2013.01); *A45D 2200/1072* (2013.01); *B65D 25/40* (2013.01)

(58) Field of Classification Search
CPC ..... A45D 40/267; A45D 2034/002; A45D 2200/1072; A45D 2200/10; A45D 34/00; B65D 51/32; B65D 75/5888; B65D 25/40; B65D 25/42; B65D 25/48; B65D 75/527
USPC ..... 215/250, 252, 253, 254, 255, 256
See application file for complete search history.

(56) References Cited

U.S. PATENT DOCUMENTS

| | | | | |
|---|---|---|---|---|
| 7,398,898 | B2 * | 7/2008 | Bouix | A45D 34/045 222/183 |
| 7,399,134 | B2 * | 7/2008 | Gueret | A45D 34/045 215/253 |
| 8,007,192 | B2 * | 8/2011 | Huang | A46B 13/02 401/129 |
| 2011/0132941 | A1 * | 6/2011 | Kim | B65D 75/5883 222/566 |

FOREIGN PATENT DOCUMENTS

| | | | |
|---|---|---|---|
| KR | 20-2014-0003580 | U | 6/2014 |
| KR | 20-2014-0004579 | U | 8/2014 |
| KR | 10-1435929 | B1 | 9/2014 |

* cited by examiner

POUCH-TYPE LIQUID COLOR MAKEUP CONTAINER

TECHNICAL FIELD

The present invention relates to a cosmetic container manufactured as a pouch type so as to accommodate a small amount of liquid cosmetics, the pouch-type liquid color makeup container: facilitating confirmation of whether the container is initially opened and exhibition and selling of the container in a vending machine and the like while enabling cosmetic materials to be conveniently carried and used indoors/outdoors through the attachment/detachment of a cap the and entrance/exit of cosmetic tools by having a cap attachment/detachment and cosmetic tool entrance/exit and rail movement guide means provided in a discharge member of a pouch manufactured so as to receive and portably carry a small amount of liquid cosmetics, such as lip gloss, mascara, and eyeliner; enabling detailed application by being stably held, thereby enabling various demands of young people sensitive to color to be satisfied.

BACKGROUND ART

In general, cosmetics are contained in a cosmetic container in the form of powder or liquid, which is sealed by a cap However, liquid color cosmetics, such as lip gloss, mascara, eyeliner, and the like, may not be completely sealed due to their characteristics, or may be hardened or deteriorated when used for a long period of time, and may be contained in a liquid cosmetic container with a limited space at a small amount for distribution.

In addition, since such liquid color cosmetics generally have to use a separate cosmetic brush or tip when used, the liquid cosmetics are manufactured and sold by additionally installing a separate cosmetic brush or tip on the cap of the container for the user's convenience. In most cases, the price is also relatively high compared to general cosmetics.

Therefore, once such color cosmetics are purchased, the color cosmetics are used for a relatively long period of time, and therefore, users who are sensitive to color and want various expressions, or users with relatively low economic power, cannot freely express various expressions using color cosmetics.

As a related art, there has been disclosed Korea registered utility model No. 20-0414842 (entitled 'Pouch-type color cosmetic container', hereinafter, referred to as 'patent document 1'), where a discharge member, which can couple or separate a cap to which a brush or tip as a cosmetic tool is attached, is installed on an upper portion of a pouch of the liquid color cosmetic container manufactured in a pouch type.

In patent document 1, the discharge member capable of attaching a brush to the pouch manufactured to store a small amount of color cosmetics such as lip gloss, mascara, and the like, so that it breaks away from the design of the existing cosmetic container and at the same time, is conveniently used by taking the cosmetic material contained in the pouch into the brush. In addition, it is possible to satisfy the needs of young people who are sensitive to color by providing a variety of low-volume, multi-colored cosmetic containers.

However, since the conventional color cosmetic container described above has a relatively short length of the cap for storage or carrying, when the cap is used as a handle and the lips, eyebrows, eyeliner, or the like are touched with a cosmetic brush or tip, it is difficult to securely grip the cap, so that the use of the cap is not appropriate when an elaborate or fine touch is required.

Accordingly, in recent years, there is a need to provide a pouch-type cosmetic container that contains a small amount of color cosmetics to be stored and carried and easily and perform fine touching indoors and outdoors inexpensively without burdening the price.

DISCLOSURE

Technical Problem

To solve the problems described above, an object of the present invention is to provide a pouch-type liquid color cosmetic container in which a discharge member for the reciprocation of a cosmetic tool, the attachment/detachment of a cap, discharge of an appropriate amount of cosmetics and rail movement guidance is installed on a pouch manufactured to contain a small amount of liquid cosmetics, such as lip gloss, mascara, and eyeliner and be portably carried, and a cosmetic tool, a strip band, and a handle are installed on the cap that is combined with or separated from the discharge member, such that the cosmetic material conveniently contained in the pouch can be easily taken and used indoors and outdoors through the attachment and detachment of the cap and the movement of the cosmetic tool. In addition, the pouch-type liquid color cosmetic container makes it easy to check whether the cap is opened for the first time using a strip band, and to display and sell using rail movements of a vending machine and the like. In addition, a reflector attached to one side surface of the pouch can be used as an auxiliary mirror, so that it breaks away from the design of an existing cosmetic container and enables a fine touch through stable gripping of the container using the handle of the cap. In addition, the pouch-type liquid color cosmetic container can satisfy the diverse needs of young people who are sensitive to color.

Technical Solution

To achieve the objects, according to one aspect of the present invention, there is provided a pouch-type liquid color makeup container which includes a pouch having an edge sealed to contain a small amount of liquid cosmetics; a discharge member tightly installed in an opening part of the pouch; a cap screw-coupled to or separated from the discharge member to seal or open the pouch; and a cosmetic tool installed to the cap by a support, wherein the discharge member includes an attachment part tightly inserted into the opening part of the pouch and attached to a lower portion of a body of the discharge member, an outlet is formed in an upper portion of the attachment part, a discharge hole is vertically formed through a central portion of the body at an inside of the body extending from the attachment part to the outlet to allow the cosmetic tool and the support to reciprocate therein, a thread is formed on an outer circumferential surface of the outlet for screw coupling of the cap, a cap stopper is formed on an outer circumferential surface of the body at a lower portion of the outlet at a height of a position spaced apart upward from the attachment part by a predetermined interval to limit a coupling depth between the cap and the discharge member, a plurality of strip band stoppers protrude radially along the outer circumferential surface of the body of the outlet on a lower portion of the cap stopper and spaced apart from each other by a predetermined interval to limit a rotational motion of a strip band of the cap, the cap includes a temporary cut line formed along a circumference of the body at a height of a position spaced by a predetermined distance from a lower end to an upper end of the body, and a strip band is formed to freely separate a part of the body by cutting the temporary cut line through the rotational motion of the body or an external force to check whether the cap is initially opened.

To achieve the objects, according to another aspect of the present invention, the cap may include a handle for facilitating a fine touch through a stable grip, in which the handle is formed by extending the body upwardly from an upper end of the cap by a predetermined length, wherein the discharge member includes a rail guide part which is provided at an upper end of the attachment part to guide a rail movement and protrudes by a predetermined length horizontally to a side of the body of the attachment part, in order to guide a slide movement of the pouch on a rail of an automation device, wherein the cosmetic tool is detachably supported and fixed to one side end of the support in which a remaining end of the support is fixed to an inside of the cap such that the coupling part is able to be separated from or recombined with the support according to purposes of makeup, and wherein a reflector is attached to at least one side surface of the pouch and used as an auxiliary mirror during makeup.

Advantageous Effects

According to the present invention, since the unit for preventing the reciprocation of the cosmetic equipment, the attachment and detachment of the cap, and excessive withdrawal of cosmetics is are installed in the discharge member of the pouch manufactured to contain a small amount of liquid cosmetics, such as lip gloss, mascara, and eyeliner and be portably carried, and the cosmetic tool and the handle are installed on cap, the cosmetic material conveniently contained in the pouch can be easily taken and used indoors and outdoors through the attachment and detachment of the cap and the movement of the cosmetic tool.

In addition, according to the present invention, the movement guide unit is installed on the discharge member, the rail movement guide unit makes it easy to display and sell using rail movements of a vending machine and the like. Since the strip band is installed on the cap, it is possible to provide an advantage of checking whether the cap is opened for the first time using the strip band of the cap.

In addition, according to the present invention, since the reflector attached to one side surface of the pouch can be used as an auxiliary mirror, it breaks away from the design of an existing cosmetic container and enables a fine touch through stable gripping of the container using the handle of the cap. In addition, the pouch-type liquid color cosmetic container can satisfy the diverse needs of young people who are sensitive to color.

BEST MODE

Mode for Invention

Figure 1:
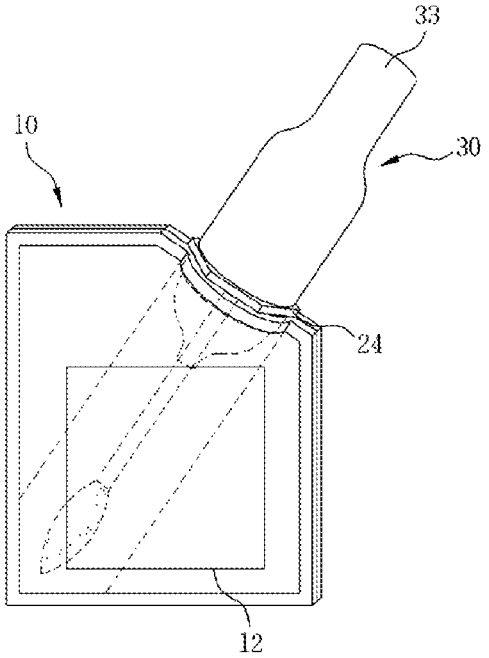
FIG. 1 is a perspective view illustrating an assembly of a pouch-type liquid color cosmetic container according to the present invention.

Hereinafter, the configuration and operation of a pouch-type liquid color cosmetic container according to a preferred embodiment of the present invention, and effects thereof will be described in detail with reference to the accompanying drawings.

It should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. The embodiments described in the present disclosure and the configurations shown in the drawings are just preferred examples for the purpose of illustration only, and at the filing time of the present disclosure, there may be various modifications that may substitute for the embodiments and drawings of the present disclosure.

Figure 2:
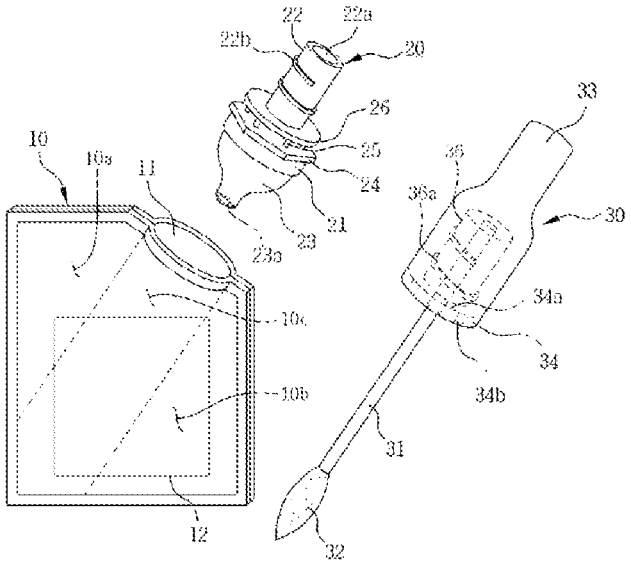
FIG. 2 is an exploded perspective view of a pouch-type liquid color cosmetic container according to the present invention.
Figure 3:
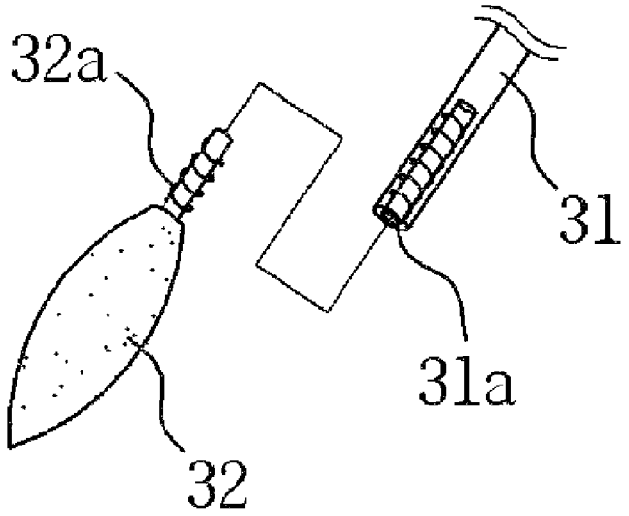
FIG. 3 is a reference diagram illustrating an operation of coupling and separating the cosmetic tool of FIG. 2.

FIG. 1 is a perspective view illustrating an assembly of a pouch-type liquid color cosmetic container according to the present invention. FIG. 2 is an exploded perspective view of a pouch-type liquid color cosmetic container according to the present invention. FIG. 3 is a reference diagram illustrating an operation of coupling and separating the cosmetic tool of FIG. 2. As shown in the drawings, a pouch-type liquid color cosmetic container according to the present invention may include a pouch 10 having an inclined opening part 11 and a reflector 12, a discharge member 20 having a rail guide part 24, a belt-band stopper 25 and a cap stopper 26, and a cap 30 having an extended handle 33 and a detachable strip band 34. In the pouch-type liquid color cosmetic container according to the present invention, the discharge member 20 is tightly installed in the opening part 11 of the pouch 10 of which the edge is sealed to contain a small amount of liquid cosmetics, the cap 30 may be coupled to the discharge member 20 to seal the inside of the pouch 10 or the cap 30 may be separated from the discharge member 20.

As shown in FIGS. 1 and 2, the edge of the pouch 10 is sealed to contain a small amount of liquid cosmetics, and the opening part 11 is formed by diagonally cutting any one of two upper corners of the pouch 10. Preferably, the opening 11 is formed to be inclined with respect to the horizontal or vertical side of the pouch 10, thereby facilitating the gripping of the pouch 10 and the cap 30. The reflector 12 may be attached to at least one side of the surface of the pouch 10 to be used as an auxiliary mirror for makeup.

In addition, the pouch 10 is formed with adhesive portions 10*a* and 10*b* by bonding the inner portions of the pouch to each other, thereby preventing the formation of space at both sides of the pouch 10 based on the opening part 11. Preferably, with the opening part 11 as the center, a storage part 10*c* that allows space formation is formed in a predetermined area of the central part where a cosmetic tool is inserted, so that a relatively small amount of a cosmetic material can be stored in a structure in which liquid cosmetics are stored.

The discharge member 20 includes an attachment part 21 which is tightly inserted into an inside of the opening part 11 of the pouch 10 and attached to a lower portion, and an outlet 22 which is formed in an upper portion of the attachment part 21. In addition, a discharge hole 22*a* through which a cosmetic tool 32 such as a brush or a tip can be inserted and penetrated vertically at the center thereof is formed inside a body connecting the attachment part 21 and the discharge part 22 of the discharge member 20. The outer circumferential surface of the outlet 22 is formed with a screw thread 22*b* into which the cap 30 can be screwed. In addition, the discharge member 20 includes a funnel part 23 for guiding the insertion and vertical movement of the cosmetic tool 32 at the center of the opening part 11 of the pouch 10 at the lower end of the attachment part 21 and withdrawing an appropriate amount of a cosmetic material. A lower outlet 23*a* for the passage of the cosmetic tool 32, which is tapered downward, is formed in the funnel part 23. Preferably, in order to prevent the cosmetic tool 32 from being drawn out in a state in which the cosmetic tool 32 composed of a brush or sponge absorbs a large amount of cosmetics, the lower outlet 23*a* of the funnel part 23 is formed to have a diameter sufficient to hold and fix the support 31 for preventing excessive withdrawal of a cosmetic material when the cosmetic tool (32) is withdrawn and preventing the support 31 from moving left and right, by compressing the diameter of the cosmetic tool 32 to a size corresponding to the diameter of the support 31.

In addition a cap stopper 26 is formed on an outer circumferential surface of the body below the outlet 22 of the discharge member 20 at a height of a position spaced apart upward from the attachment part 21 by a predetermined interval to limit a coupling depth between the cap 30 and the discharge member 20. A plurality of strip band stoppers 25 protrude radially along the outer circumferential surface of the body of the outlet 22 on a lower portion of the cap stopper 26 and are spaced apart from each other by a predetermined interval to limit a rotational motion of the strip band of the cap 30.

In addition, a rail guide part 24 for guiding a rail movement protrudes at a certain length horizontally to a side of the body of the attachment part 21 from an upper end of the attachment part 21 of the discharge member 20, such that the sliding movement on a rail required for storage, display, or sale for unmanned sales in a vending machine, or between manufacturing processes in an automated system or device is guided. The rail guide 24 may be formed in one of a circular shape, a hexagonal shape, or an octagonal shape in order to be stably installed on the rail of the automated device.

The cap 30 has a discharge member coupling part 36 and a screw groove 36*a* for screwing the discharge member 20 formed inside the body thereof and screwed with the discharge member 20 to close the inside of the pouch 10 or be separated from the discharge member 20, so that a cosmetic material is stuck on a cosmetic tool (32: a brush or a tip) inside the cap 30 to apply color makeup. In the cap 30, the upper end of the support 31 is fixed and installed inside the discharge member coupling part 36 and the cosmetic tool 32 is fixed to and supported by a lower end of the support 31.

The cosmetic tool 32 may be composed of a brush, a sponge or a tip, and as illustrated in FIG. 3, be detachably screwed to the end of the support 31. If necessary, the cosmetic tool 32 may be used to be separated from or recombined with the support 31 to suit the cosmetic use. To this end, an assembly hole 31*a* for attaching and detaching the cosmetic tool 32 may be formed in the lower end of the support 31, and a coupling portion 32*a* may be formed in the upper end of the cosmetic tool 32 to be attached and detached corresponding to the assembly hole 31*a* of the support 31.

In addition, the cap 30 includes a temporary cut line 34*a* which is formed along a circumference of the body at a height of a position spaced a predetermined distance from a lower end to an upper end of the body and is integrated with the cap 30 at the time of initial manufacture, and a strip band 34 which is formed to freely separate the body from the cap 30 by cutting the temporary cut line 34*a* through the rotational motion or an external force to check whether the cap is initially opened. A plurality of belt-band stopper seating grooves 34*b* into which the band-band stopper 25 of the discharge member 20 is inserted and placed on the inner circumferential surface thereof may be formed in the strip band 34.

In addition, a handle 33 is formed by extending the body upwardly from the upper end of the cap 30 at a predetermined length, so that the cap 30 may be stably gripped by using the handle 33. Therefore, it is possible to touch finely when the makeup is applied after the cosmetic material is stuck on the cosmetic tool 32 additionally installed on the inside of the cap 30.

Hereinafter, the effect of the pouch-type liquid color cosmetic container according to the present invention configured as described above will be described.

As shown in FIGS. 1 and 2, after attaching the reflector 12 to at least one side surface of the pouch 10 to be used as an auxiliary mirror for makeup, the edges of the pouch 10 are sealed. The opening 11 is formed to be inclined with respect to the horizontal or vertical side of the pouch 10 by diagonally cutting one of the two upper corners of the pouch 10 whose edges are sealed. The discharge member 20 may be easily inserted through the opening part 11 in the oblique direction of the pouch 10, and also facilitates gripping of the pouch 10 and the cap 30 when used in the future.

Next, with the opening 11 of the pouch 10 as the center, the inner portions of the body on both sides of the pouch 10 are bonded to form adhesive portions 10*a* and 10*b*, thereby preventing space formation. A space for containing liquid cosmetics is formed only in a predetermined area of the central portion where the cosmetic tool 32 is inserted with respected to the opening part 11 to form the receiving portion 10*c*, such that a small amount of liquid cosmetics is contained in the pouch 10.

Then, after the funnel part 23 and the attachment part 21, which are formed on the lower portion of the discharge member 20, are inserted into the opening part 11 of the pouch 10, and the opening part 11 of the pouch 10 is tightly attached around the attachment part 21 to complete the coupling of the discharge member 20 to the opening part 11 of the pouch 10, a small amount of liquid cosmetics is automatically injected into the receiving portion 10*c* of the pouch 10 through the discharge hole 22*a* of the outlet 22 formed in the upper portion of the attachment part 21. The automatic injection operation of the liquid cosmetics may be performed through an automated device or the like. In this case, the pouch 10 may be installed to slidably move on a rail such as an automated device by using the rail guide part 24 formed on the upper end of the attachment part 21 of the discharge member 20.

When the injection of the liquid cosmetic into the pouch 10 is completed as described above, while the cosmetic tool 32 such as a brush, a tip, or the like installed on the cap 30 and the support 31 are sequentially inserted through the discharge hole 22*a* and the lower outlet 23*a* of the funnel part 23, the screw thread 22*b* on the outer circumferential surface of the outlet 22 is allowed to correspond to the discharge member coupling part 36 of the cap 30 and the screw groove 36*a*, such that the cap 30 is screwed into the outlet 22 of the discharge member 20, thereby allowing the cap 30 to initially seal the pouch 10. In this case, the coupling depth between the cap 30 and the discharge member 20 may be appropriately limited by the cap stopper 26, and the cosmetic tool 32 that is inserted into the discharge hole 22*a* and moves downward may guide the insertion operation by the funnel part 23 formed on the lower end of the attachment part 21 to guide the vertical movement. In addition, since the support 31 inserted into the pouch 10 may be held and fixed by the lower outlet 23*a* of the funnel part 23, it is possible to prevent the support 31 from moving left and right. Later, when the cosmetic tool 32 is withdrawn, since the cosmetic tool 32 can be withdrawn in a suitably compressed state by the lower outlet 23*a* of the funnel part 23, when the cosmetic material is absorbed excessively into the cosmetic tool 32 composed of a sponge, a brush, or the like, it is possible to prevent the cosmetic material from being discharged in a state that the cosmetic material is excessively stuck onto the cosmetic tool 32.

Meanwhile, the lower end of the cap 30 is integrally formed with the strip band 34 in which the body is freely separated from the cap 30 by cutting the temporary cutting line 34*a*. The plurality of belt-band stopper seating grooves 34*b* into which the belt-band stopper 25 of the discharge member 20 is inserted and placed on the inner circumferential surface thereof may be formed in the strip band 34. In addition, the cap stopper 26 is formed on the outer circumferential surface of the body below the outlet 22 at a height of the position spaced apart upward from the attachment part 21 by a predetermined interval to limit the coupling depth between the cap 30 and the discharge member 20. Since the plurality of strip band stoppers 25 protrude radially along the outer circumferential surface of the body of the outlet 22 on the lower portion of the cap stopper 26 and are spaced apart from each other by a predetermined interval, when the pouch 10 is first sealed with the cap 30 as described above, thereafter, by the strip band stopper 25 formed on the discharge member 20 and the plurality of strip band stopper seating grooves 34*b* formed inside the strip band 34 of the cap 30, it is possible to temporarily limit the strip band rotation operation of the cap 30.

When the first sealing is made as described above, according to the pouch-type liquid color cosmetic container of the present invention, the movement between manufacturing processes in an automated system or device, or the sliding movement on the rail required for storage, exhibition or sale for unmanned sales in a vending machine or the like may be made through the rail guide 24.

Finally, when the handle 33 is gripped and a certain amount of rotational force (for example, which may be an amount of force capable of cutting the temporary cutting line) in the direction of separating the screw connection of the cap 30 is applied to the cap 30 in order to use the cosmetic material stored in the pouch 10 (or other external force is applied), although the strip band 34 does not rotate, whose rotational motion is restricted by the lower body of the temporary cutting line 34*a* of the cap 30, that is, the strip band stopper 25 formed on the discharge member 20 and the plurality of strip band stopper seating grooves 34*b* formed inside the strip band 34 of the cap 30, the rotational force applied to the handle 33 acts in one direction (for example, the direction in which the screw is separated) on the upper body of the temporary cutting line 34*a* of the cap 30. Thus, when an amount of force capable of cutting the temporary cutting line 34*a* is applied, the temporary cutting line 34*a* is cut, and the body of the strip band 34 is freely separated from the cap 30 to open the pouch 10 for the first time. Accordingly, the pouch-type liquid color cosmetic container according to the present invention enables the user to check whether the cap 30 is initially opened by cutting the temporary cutting line 34*a*.

Thereafter, if necessary, the cap 30 is screwed to the outlet 22 of the discharge member 20 to seal the inside of the pouch 10, or the cap 30 is separated from the discharge member 20, so that it is possible to withdraw an appropriate amount of cosmetic material with the cosmetic tool (brush or tip) 32 therein, so it is possible to freely apply color makeup.

Meanwhile, since the cosmetic tool 32 additionally installed on the cap 30 may be detachably screwed by using the assembly tool 31*a* at the end of the support 31 and the coupling part 32*a* at the upper end of the cosmetic tool 32, if necessary, it is possible to conveniently use a brush or tip, or replace it with a new one.

According to the present invention, since liquid cosmetics such as lip gloss, mascara, and eyeliner are accommodated in the pouch 10 in a small amount that can be used several times, it is convenient to carry it. In addition, since the reflector attached to one side surface of the pouch may be used as an auxiliary mirror for makeup, it is possible to conveniently take and use the cosmetic material contained in the pouch indoors and outdoors.

In addition, according to the present invention, since it is possible to check whether a brush or the like is used by using the strip band, it is easy to display and sell in a vending machine, and the like by using the rail moving guide unit, and it is possible to stably grip the cap by using the handle extended from the upper end of the cap. In addition, by enabling a fine touch, the shortcomings of existing cosmetic containers may be supplemented, and the diverse needs of young people who are sensitive to color may be satisfied.

While the present invention has been described above using particular examples with reference to the accompanying drawings, the present invention is not to be limited to the embodiments above, and various modifications and alterations can be made from the disclosures above by a person having ordinary skill in the art to which the present invention pertains. Therefore, the spirit of the present invention must not be limited to the embodiments described herein, and the scope of the present invention must be regarded as encompassing not only the claims set forth below, but also their equivalents and variations.

The invention claimed is:

1. A pouch-type liquid color makeup container comprising:

a pouch having an edge sealed to contain a small amount of liquid cosmetics;

a discharge member tightly installed in an opening part of the pouch;

a cap screw-coupled to or separated from the discharge member to seal or open the pouch; and a cosmetic tool installed to the cap by a support, wherein:

the discharge member includes an attachment part tightly inserted into the opening part of the pouch and attached to a lower portion of a first body of the discharge member, an outlet is formed in an upper portion of the attachment part, a discharge hole is vertically formed through a central portion of the first body of the discharge member at an inside of the first body of the discharge member extending from the attachment part to the outlet to allow the cosmetic tool and the support to reciprocate therein, a thread is formed on an outer circumferential surface of the outlet for screw coupling of the cap, a cap stopper is formed on an outer circumferential surface of the first body of the discharge member at a lower portion of the outlet at a height of a position spaced apart upward from the attachment part by a predetermined interval to limit a coupling depth between the cap and the discharge member, a plurality of strip band stoppers protrude radially along the outer circumferential surface of the first body of the discharge member on a lower portion of the cap stopper and spaced apart from each other by a predetermined interval to limit a rotational motion of a strip band of the cap, the cap includes a temporary cut line formed along a circumference of a second body of the cap at a height of a position spaced by a predetermined distance from a lower end to an upper end of the second body of the cap, a strip band is formed to freely separate a part of the second body of the cap by cutting the temporary cut line through the rotational motion of the second body of the cap or an external force to check whether the cap is initially opened, the discharge member includes a rail guide part which is provided at an upper end of the attachment part to guide a rail movement and protrudes by a predetermined length horizontally to a side of the attachment part in order to guide a slide movement of the pouch on a rail of an automation device, the plurality of strip band stoppers are formed in a pillar shape between the lower portion of the cap stopper and an upper portion of the rail guide part, and a plurality of belt-band stopper seating grooves are formed on an inner circumferential surface of the strip band of the cap such that each of the plurality of strip band stoppers is inserted into each of the plurality of belt-band stopper seating grooves of the strip band thereby limiting the rotational motion of the strip band of the cap.

2. The pouch-type liquid color makeup container of claim 1, wherein the opening part is configured to be inclined with respect to a horizontal or vertical side by diagonally cutting one of two corners of an upper portion of the pouch.

3. The pouch-type liquid color makeup container of claim 1, wherein a reflector is attached to at least one side surface of the pouch and used as an auxiliary mirror during makeup.

4. The pouch-type liquid color makeup container of claim 1, wherein the discharge member includes a funnel part for guiding an insertion and a vertical movement of the cosmetic tool at a center of the opening part of the pouch on a lower end of the attachment part, and wherein the funnel part is tapered downward and is formed with a lower outlet for allowing the cosmetic tool to reciprocate therein.

5. The pouch-type liquid color makeup container of claim 4, wherein the lower outlet of the funnel part has a diameter sufficient to hold and fix the support to prevent an excessive amount of a cosmetic material from being discharged and prevent the support from moving left and right when the cosmetic tool is withdrawn.

6. The pouch-type liquid color makeup container of claim 1, wherein the cap includes a handle for facilitating a fine touch through a stable grip, in which the handle is formed by extending the second body of the cap upwardly from an upper end of the cap by a predetermined length.

7. The pouch-type liquid color makeup container of claim 1, wherein:

the cosmetic tool is detachably supported and fixed to one side end of the support in which a remaining end of the support is fixed to an inside of the cap, an assembly tool for attaching and detaching the cosmetic tool is formed on a lower end of the support, and a coupling part is formed on an upper end of the cosmetic tool and assembled corresponding to the assembly tool of the support, such that the coupling part is able to be separated from or recombined with the support depending on purposes of makeup.

* * * * *